United States Patent [19]

Zins

[11] 4,422,483

[45] Dec. 27, 1983

[54] ANTISTATIC FABRIC AND GARMENT MADE THEREFROM

[75] Inventor: Howard M. Zins, Manchester, Mo.

[73] Assignee: Angelica Corporation, St. Louis, Mo.

[21] Appl. No.: 269,910

[22] Filed: Jun. 3, 1981

[51] Int. Cl.[3] ..... D03D 15/00; A41B 0/00; B32B 9/00

[52] U.S. Cl. ..... 139/420 R; 2/69; 57/901; 428/368

[58] Field of Search ..... 2/2, 69, 114; 57/244, 57/901; 428/367, 368, 93, 96, 97; 139/420 R, 425 R, 391

[56] References Cited

U.S. PATENT DOCUMENTS

| | | | |
|---|---|---|---|
| 3,288,175 | 11/1966 | Valko | 139/425 R |
| 3,359,567 | 12/1967 | Zemme et al. | 2/2 |
| 3,422,460 | 1/1969 | Burke et al. | 139/425 R X |
| 3,823,035 | 7/1974 | Sanders | 428/368 |
| 4,045,949 | 9/1977 | Paton et al. | 428/367 X |
| 4,061,827 | 12/1977 | Gould | 428/367 X |
| 4,232,082 | 11/1980 | Noritake | 428/368 X |

*Primary Examiner*—Richard J. Scanlan, Jr.
*Attorney, Agent, or Firm*—Rogers, Eilers & Howell

[57] ABSTRACT

A garment for use in "clean rooms" is made from a tightly-woven, readily-cleanable, non-linting fabric with conductive filaments that provide anti-static properties. The conductive filaments are incorporated into the woven fabric of the garment so portions thereof constitute parts of the exterior of that garment to enable those conductive filaments to rapidly dissipate any charge of static electricity which may tend to develop on the surface of that garment. Those conductive filaments retain their ability to rapidly dissipate charges of static electricity despite repeated launderings of the garment in which they are incorporated.

4 Claims, 3 Drawing Figures

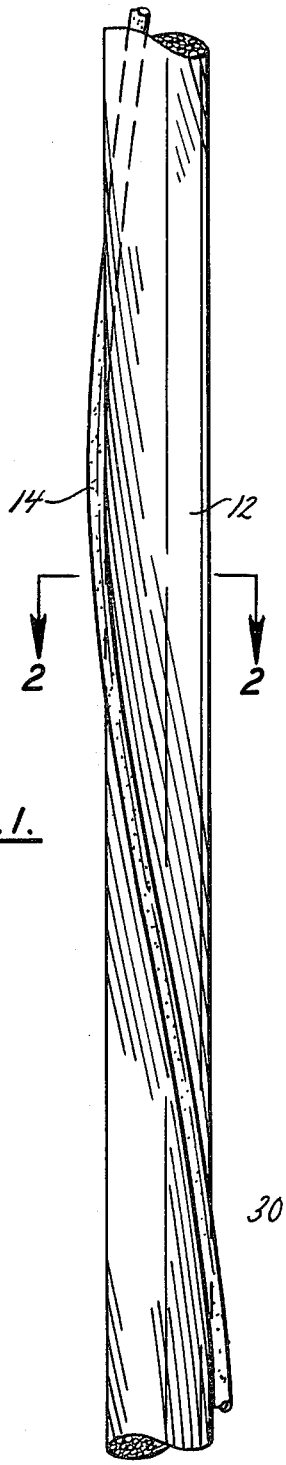
FIG. 1.
FIG. 2.
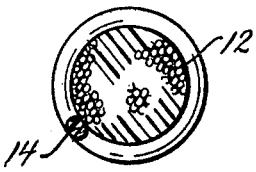
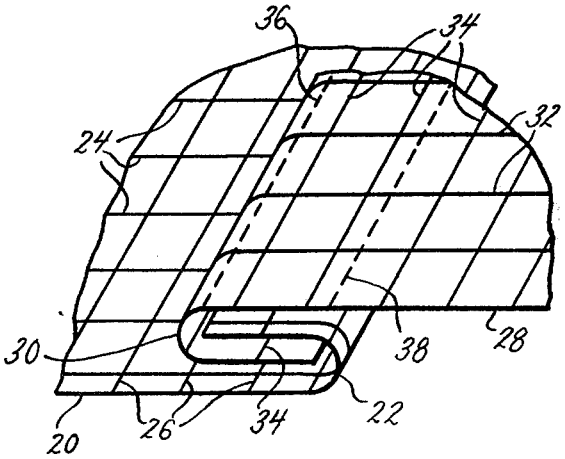
FIG. 3.

ANTISTATIC FABRIC AND GARMENT MADE THEREFROM

BACKGROUND OF THE INVENTION

1. Field of the Invention:

Charges of static electricity can develop on clothing as the wearers of the clothing move their arms and legs and also as they walk on non-conductive floor surfaces. When the relative humidity of the ambient atmosphere is very low, the charges of static electricity tend to develop readily; and those charges can become sizeable—in many instances reaching several thousands of volts. Static electricity charges are not only annoying—because they cause clothing to cling to the wearer's body, and also because they cause fine particles of lint and dust to collect on the clothing—but those charges can damage sensitive microcircuits, sensitive integrated circuits and other sensitive semi-conductors which are being handled by the wearer of the clothing. Specifically, charges of static electricity which are as small as six hundred volts can damage some sensitive microcircuits, sensitive integrated circuits and other sensitive semi-conductors. To minimize the development of charges of static electricity on clothing, and also to limit the sizes of any such charges which may develop on clothing, efforts have been made to incorporate electrically conductive elements into clothing or to apply antistatic chemicals to the clothing.

2. Description of the Prior Art

Antistatic chemicals are marketed in the form of additives to detergents, in the form of aerosol sprays to be sprayed onto clothing, and in the form of additives to "washes"; and those chemicals are helpful in reducing the tendency of clothing to cling to the wearer. However, those chemicals are not able to keep potentially-damaging charges of static electricity from developing on the surface of clothing. Also, those chemicals are not permanent in nature, and hence must be applied after each washing of the clothing. Further, some of those chemicals can form films on the surfaces of the clothing which can flake off and become contaminants, and hence make the treated clothing unusable in "clean rooms". In addition, those chemicals produce variable results where the persons who use those chemicals fail to use the specified amounts and proportions of those chemicals.

Metallic laminate threads—each of which consisted of a bottom ply of thin narrow plastic, a middle ply of thin narrow metal and top ply of thin narrow plastic—have been used. However, the conductivity of the metal in the middle plies of those metallic laminate threads was so high that those middle plies were made with gaps therein to protect persons—who walked on rugs made with yarns in which those metallic laminate threads were incorporated—from the risk of electrocution. Those metallic laminate threads were rectangular in cross section and were relatively wide—frequently one hundredth of an inch wide; and hence were not usable in making thin, light clothing for "clean rooms". Also, because those middle plies of metal were extremely thin—frequently forty-five hundred-thousandths of an inch thick—and because only the thin edges thereof were exposed, those metallic laminate threads could not keep sizeable charges of static electricity from forming on the surfaces of any garment in which they might be incorporated.

Large numbers of lengths of small diameter stainless steel threads or wire have been incorporated into yarns which have been used to weave fabrics; and those lengths of stainless steel threads or wire have enabled clothing, which was made from those fabrics, to discharge potentially-damaging charges of electricity and also to reduce the tendency of such clothing to cling to the wearer. However, those fabrics are not limited-linting fabrics, and hence they are not desirable for use in "clean rooms".

Monofilaments of polymeric material have had conductive particles embedded in the surfaces thereof to make those monofilaments conductive; and those monofilaments have been incorporated into clothing. In some instances, those monofilaments have been incorporated into warp knit fabrics; and, when properly incorporated into such fabrics, those monofilaments have been able to keep potentially-damaging charges of static electricity from developing on the surface of clothing made from those fabrics. However, those warp knit fabrics could not substantially prevent the passage therethrough of hair and flaked-off particles of skin, and hence were not suitable for use in "clean rooms". Those monofilaments also have been incorporated into woven fabrics and, when so incorporated, those monofilaments have minimized the tendency of clothing, made from those fabrics, to cling to the wearer. However, those monofilaments were unable to keep potentially-damaging charges of static electricity from developing on the surface of clothing made from those fabrics.

SUMMARY OF THE INVENTION

The present invention provides a woven fabric that produces a charge decay of ninety percent from an applied voltage of five thousand volts within one-half of a second and that keeps charges of static electricity in excess of six hundred volts from developing on the surface thereof. That woven fabric has a plurality of non-conductive warp threads and a plurality of non-conductive fill threads; and each of those threads has a denier of about one hundred and fifty or greater. Where it has a plain weave and is in its finished state, that fabric has at least sixty-six warp threads per inch and at least fifty fill threads per inch. Where that woven fabric has a herringbone, twill or basket weave and is in its finished state, that fabric has at least seventy warp threads per inch and at least sixty fill threads per inch. A majority of the warp threads are non-textured threads made from a multiplicity of continuous filaments which are non-conductive, and hence the majority of the warp threads are non-textured, non-conductive, multi-filament threads. Similarly, a majority of the fill threads are non-textured threads made from a multiplicity of continuous filaments which are non-conductive, and hence the majority of the fill threads are non-textured, non-conductive, multi-filament threads. Each of a minority of the warp threads is conductive from end to end, because it includes a non-textured monofilament of plastic which has vast numbers of tiny conductive particles embedded in the surface thereof. That monofilament is ply twisted with at least one non-textured, non-conductive ply which is made from a multiplicity of continuous filaments that are non-conductive. Similarly, each of a minority of the fill threads is conductive from end to end, because it includes a non-textured monofilament of plastic which has vast numbers of tiny conductive particles embedded in the surface thereof. That monofilament is ply twisted with at least one non-textured, non-conductive ply which is made from a multiplicity of continuous filaments that are non-conductive. The diameter of each non-textured monofilament in the conductive warp threads, and the diameter of each non-textured monofilament in the conductive fill threads, is substantially smaller than the diameter of each non-textured, non-conductive ply in those threads; and hence the cross section of each of those non-textured monofilaments is very much smaller than the cross section of each of those non-textured, non-conductive plies. The resulting large disparity between the cross sections of the non-textured monofilament and of the non-textured, non-conductive ply or plies of each conductive warp or fill thread enables the non-textured, non-conductive ply or plies to provide the major portion of the strength of the conductive thread. Further, that large disparity enables that non-textured monofilament to be given, and to retain, the form of an open-type helix as it is ply-twisted with the non-textured, non-conductive ply or plies. Because each non-conductive ply of each conductive wrap or fill thread is made from non-textured continuous filaments, and hence is relatively thick and relatively strong, that non-conductive ply helps protect the non-textured monofilament from breaking as the conductive thread is incorporated into the woven fabric, and also as that woven fabric experiences local stresses during wear. Consequently, each of the conductive threads of the woven fabric provided by the present invention has a small diameter, non-textured continuous filament which is continuously and uninterruptedly conductive between the ends thereof, which is ply-twisted with one or more larger-diameter, stronger plies of non-textured, continuous, non-conductive filaments, and which has the major portion of the surface thereof exposed to constitute a portion of the surface of that conductive thread.

It is, therefore, an object of the present invention to provide each conductive thread of a woven fabric with a small-diameter, non-textured, continuous filament which is continuously and uninterruptedly conductive between the ends thereof, which is ply-twisted with one or more larger-diameter, stronger plies of non-textured, continuous, non-conductive filaments, and which has the major portion of the surface thereof exposed to constitute a portion of the surface of that conductive thread.

The woven fabric provided by the present invention produces a charge decay of ninety percent from an applied voltage of five thousand volts within one-half of a second; and hence rapidly dissipates any charges of static electricity which may develop on the surface of clothing made from that woven fabric. In addition, that woven fabric can limit the values of charges of static electricity, which a wearer's movements can cause to develop on clothing made from that woven fabric, to less than six hundred volts. As a result, the woven fabric provided by the present invention can be incorporated into clothing which will be worn by persons handling sensitive microelectric circuits, sensitive integrated circuits and other sensitive semi-conductive devices. It is, therefore, an object of the present invention to provide a woven fabric that produces a charge decay of ninety percent from an applied voltage of five thousand volts within one-half of a second and that can limit the values of charges of static electricity, which a wearer's movements can cause to develop on clothing made from that woven fabric, to less than six hundred volts.

"Clean room" garments, which are made from the woven fabric of the present invention, have conductive threads in the warp, and also in the fill, thereof. As a result, each section of that garment can conduct static electric charges thereon to the peripheries of those sections. Where a section of that garment is connected to another section of that garment, a double needle, two-fold seam is used; and such a seam makes certain that several of the conductive threads of the one section engage one or more of the conductive threads of the other section. The engagements of those conductive threads enable any static electric charges on any one section of the garment to pass to any other section of that garment where those charges can be dissipated. It is, therefore, an object of the present invention to provide "clean room" garments which have conductive threads in the warp, and also in the fill, of the fabric of the sections thereof and which use double needle, two-fold seams to interconnect the sections thereof so several of the conductive threads of the one section engage one or more of the conductive threads of the other section.

Other and further objects and advantages of the present invention should become apparent from an examination of the drawing and accompanying description.

In the drawing and accompanying description, a preferred embodiment of the present invention is shown and described, but it is to be understood that the drawing and accompanying description are for the purpose of illustration only and do not limit the invention and that the invention will be defined by the appended claims.

BRIEF DESCRIPTION OF THE DRAWING

FIG. 1 is a magnified side view of a plural-ply conductive thread which is usable in making woven fabrics for garments usable in "clean rooms", FIG. 2 is a sectional view which is taken along the plane indicated by the line 2—2 in FIG. 1, and FIG. 3 is a perspective view of a seam between two sections of a garment which is made from a woven fabric that has the plural-ply conductive thread of FIGS. 1 and 2 hereof incorporated in it.

DETAILED DESCRIPTION OF THE PREFERRED EMBODIMENT

Referring to the drawing in detail, the numeral 12 denotes a multiplicity of elongated filaments of very small diameter which are essentially parallel to each other and which coact to constitute one ply of a plural-ply conductive thread for woven fabrics that can be used in making garments which are usable in "clean rooms". Those elongated filaments are non-textured, continuous, non-conductive filaments. In the preferred embodiment of the present invention, the filaments 12 are standard and usual polyester filaments which are made by the Celanese Corporation or by the Eastman Chemical Company and which have such small diameters that thirty-six of them are needed to form a yarn of seventy denier. Two such yarns are then combined together to constitute, or to simulate, a single ply, as shown particularly by FIG. 2. Those yarns can be combined together in advance of, or during, the step wherein a non-textured, continuous, conductive monofilament 14 is combined with those yarns to form the conductive thread of the present invention.

The monofilament 14 has conductive particles embedded in the surface thereof to render that non-textured, continuous monofilament capable of conducting static electricity. Although different non-textured, continuous, conductive monofilaments with embedded conductive particles could be used, it is preferred to use a 21-denier conductive nylon 6 monofilament which is made by the Dow Badische Company. That monofilament has a denier of 21 plus or minus 2, a minimum tenacity of 3.5 grams per denier, a minimum extension of 20%, a shrinkage of 7.5% plus or minus $2\frac{1}{2}$%, and a resistance of $5\times10^6$ ohms per centimeter. The carbon particles in the surface of the monofilament 14 constitute, and provide, an essentially-continuous surface along the entire length of that monofilament.

The diameter of the monofilament 14 is much smaller than the diameter of the conductive thread which includes that monofilament and the single, or simulated-single, ply constituted by the multiplicity of filaments 12. In the preferred embodiment of the present invention, the diameter of the monofilament 14 averages about fifty microns, the diameters of the conductive warp threads average about two hundred and ninety-six to three hundred and twelve microns, and the diameters of the conductive fill threads average about three hundred and twenty microns. As a result, the cross section of the monofilament 14 is smaller than three hundredths of one percent of the cross section of the conductive thread.

The conductive thread of the present invention can be formed by initially combining a plurality of multi-filament yarns to make, or to simulate, a single, multi-filament ply and then ply-twisting that ply with the monofilament 14. Alternatively, that conductive thread can be made by initially keeping the plurality of multi-filament yarns separate from each other and then simultaneously ply-twisting them and the monofilament together. In addition, that conductive thread can be made by ply-twisting the monofilament with a single ply which has a large number of filaments and which has a cross section that is close to the sum of the cross sections of a plurality of multi-filament yarns. In each modification of the conductive thread of the present invention, the monofilament 14 will have the configuration of an open-type helix, and it will constitute an appreciable part of the outer surface of that conductive thread. FIGS. 1 and 2 show the monofilament 14 as having mere line contact with a cylindrical "envelope" which is defined by the multitude of filaments 12; but that monofilament actually compresses longitudinally-spaced portions of that "envelope" so the conductive thread has a generally-variable diameter. That compressing will occur as that monofilament is ply-twisted with that "envelope"; and it will cause portions of that "envelope" to incline inwardly toward the monofilament 14 at shallow angles and then incline outwardly away from that monofilament at comparable shallow angles. However, the major portion of the monofilament 14 will be disposed outwardly of the axis of the conductive thread by a distance close to the radius of the "envelope". Also, the major portion of the surface of the monofilament 14 will constitute an appreciable part of the surface of the conductive thread. In the preferred embodiment of the present invention, the monofilament 14 and the multitude of filaments of the "envelope" are plytwisted so that monofilament makes about four to four and one-half turns per inch. That multitude of filaments makes about the same number of turns per inch.

The carbon of the monofilament 14 and the nylon of that monofilament are desirable because they do not adversely affect human skin. Similarly, the polyester filaments 12 are desirable because they do not adversely affect human skin. The fact that the monofilament 14 has a cross section which is very substantially smaller than the overall cross section of the conductive thread and the fact that each of the filaments 12 has a cross section which is smaller than the cross section of that monofilament enable fabrics, which include that conductive thread, to be flexible and soft, to have a desirable "feel" and "hand", and to provide a desirable "cover" despite the hard and stiff nature of the nylon of that monofilament.

The fact that the single, or simulated-single, ply of the conductive thread is made from a multitude of very small-diameter filaments enables the "envelope", which is defined by those filaments, to have sufficient yieldability and "give", in response to laterally-applied forces, to enable the conductive thread to coact with non-conductive threads in a woven fabric to provide the "cover" which is needed to resist the passage through that woven fabric of particles of skin and hair. That yieldability and "give" also enable such a woven fabric to be flexible enough and soft enough, to have a sufficiently desirable "feel" and "hand", and to permit the wearer of a garment, made from that woven fabric, to be comfortable. However, the single, or simulated-single, ply of the conductive thread must not have so much yieldability and "give", in response to laterally-directed forces, that the monofilament 14 could become "buried" within the "envelope"—defined by that single, or simulated-single, ply—during the ply-twisting of that monofilament with that single, or simulated-single, ply. Also, the single, or simulated-single, ply of the conductive thread must not have so much yieldability and "give", in response to laterally-directed forces, that the monofilament 14 could assume a random and irregular orientation or configuration during the ply-twisting of that monofilament with that single, or simulated-single, ply. The use of a non-textured, continuous, multi-filament single, or simulated-single, ply, which has a diameter that is several times larger than the diameter of the monofilament, provides the required yieldability and "give" in response to laterally-directed forces, and yet does not permit that monofilament to become "buried" in the "envelope", and does not permit that monofilament to assume a random and irregular orientation or configuration during the ply-twisting of that monofilament with that single, or simulated-single, ply.

The open-type helical configuration of the monofilament 14 limits the tensile forces which can be applied to that monofilament during any stretching of the conductive thread as any woven fabric, in which that conductive thread is incorporated, flexes or stretches in use. Also, that open-type helical configuration keeps that monofilament from limiting the flexing or stretching of such a woven fabric. In addition, that open-type helical configuration coacts with the displacing of the major portion of that monofilament outwardly of the axis of the conductive thread, to expose the major portion of that monofilament. Such exposure is important because the $5\times10^6$ ohms per centimeter resistance of that monofilament is far closer to the $2\times7^7$ ohms per centimeter resistance of Bakelite 140, which is classified as a dielectric, than it is to the $3.5\times10^3$ ohms per centimeter resistance of carbon, which is classified as a conductor. That exposure, plus the fact that the monofilament 14 is continuous and uninterrupted throughout the length of the conductive thread provided by the present invention—to provide a continuous and uninterrupted electrical path—enables that conductive thread to conduct charges of static electricity. All of this means that the present invention provides a conductive thread which enables fabrics that include that conductive thread to be flexible and soft, to have a desirable "feel" and "hand", to provide a desirable "cover", and to effect the discharging of charges of static electricity.

The fact that the conductive thread of the present invention has a conductive monofilament which is plied, as an open-type helix, around an "envelope" that has a much larger cross section and that is defined by a multitude of non-textured, continuous filaments enables that conductive thread to be woven into a fabric. One preferred woven fabric that is made with that conductive thread has a 150 denier base yarn that is composed of thirty-two non-textured, continuous filaments of American Enka Semi-Dull Polyester; and that base yarn is used both in the warp and fill. When that woven fabric is in the greige state, it has seventy-two ends per inch and sixty-eight picks per inch, the conductive thread ends are spaced apart four hundred and six thousandths of an inch, and the conductive thread picks are spaced apart five hundred and fifteen thousandths of an inch. When a herringbone weave is used, the greige width is forty-nine inches, and the greige weight is four and five-hundredths of an ounce per lineal yard. After that woven fabric is finished, it has eighty-two ends per inch and sixty-eight picks per inch, the conductive thread ends are spaced apart about three-eights of an inch, and the conductive thread picks are spaced apart about one-half of an inch.

A preferred woven fabric, that has a plain weave, has the same base yarn; but, in its finished state, that woven fabric has seventy-five ends and sixty picks. The conductive thread ends are spaced apart about three-eights of an inch and the conductive thread picks are spaced apart about one-half of an inch.

Each of those preferred forms of woven fabric can meet the requirements of the NFPA 56A test, of the AATCC Test Method 76-1978, and of the Federal Test Method 101B. Specifically, when each of those fabrics is tested in accordance with Sections 4663 and 4664 of NFPA Code 56A, it exhibits a charge decay of ninety percent from an applied voltage of five thousand volts within one-half of a second, and it also displays a surface resistivity which does not exceed $1\times10^{11}$ ohms. Actually, each of those woven fabrics has a higher capability for discharging charges of static electricity than is required by any of those tests. Specifically, each of those fabrics can limit the maximum charge which can develop on the surface of any new garment, into which it is incorporated, to less than six hundred volts, as shown by the following chart of the results of tests made, in a thirty percent relative-humidity atmosphere, on a coverall (garment A) which was made from a woven fabric having no conductive threads, on a coverall (garment B) which was made from the hereinbefore-described herringbone fabric, on a laboratory coat (garment C) which was made from a fabric having no conductive threads, and on a laboratory coat (garment D) which was made from the hereinbefore-described herringbone fabric:

| State of Garment | Maximum Measured Charges | | | |
|---|---|---|---|---|
| | Garment A | Garment B | Garment C | Garment D |
| As removed from package | 50–100 volts | less than 50 volts | 50 volts (a 2500 volt "hot spot" due to the removal of the garment from its plastic package was noted) | 50 volts (a 300 volt "hot spot" due to the removal of the garment from its plastic package was noted) |
| As worn | less than 50 volts | less than 50 volts | less than 50 volts | less than 50 volts |

Garments A and B, and an identical set of garments A and B, were delivered to a commercial dry-cleaning establishment and were subjected to fifty dry cleanings. Thereafter, they provided the following results in a thirty percent relative-humidity atmosphere:

| State of Garment | Maximum Measured Charges | |
|---|---|---|
| | Garment A | Garment B |
| Back of garment as received from dry cleaner | Greater than 5000 volts | 0 |
| Front of garment as received from dry cleaner | Greater than 5000 volts | 0 |
| As worn | 3000–5000 volts | 0 |

A further set of garments A and B was delivered to that dry-cleaning establishment and subjected to fifty commercial dry cleanings; but, during the last two dry-cleanings, those garments received a clear solvent rinse with no detergent or softener. Thereafter, they provided the following results in a thirty percent relative-humidity atmosphere:

| State of Garment | Maximum Measured Charges | |
|---|---|---|
| | Garment A | Garment B |
| Back of garment as received from dry cleaner | 4400–5000 volts | 0 |
| Front of garment as received from dry cleaner | 5000–5500 volts | 50 volts |
| As worn | 2000 volts | 0 |

A still further set of garments A and B was delivered to a commercial laundry and was subjected to fifty commercial launderings. Thereafter, that set was tested in a thirty percent relative-humidity atmosphere with the following results:

| State of Garment | Maximum Measured Charges | |
|---|---|---|
| | Garment A | Garment B |
| As removed from dryer used by laundry | 50–100 volts | 50 volts |
| Back of garment before it was worn | 200 volts | 0 |
| Front of garment before it was worn | 2000 volts | 50 volts |
| As worn | 50–100 volts | 0 |

Yet another set of garments A and B was subjected to fifty launderings; but a softener-antistatic chemical was used during each of those launderings. The use of that chemical seemed to have little effect, other to tend to reduce the wrinkling in the garments.

Garments C and D were worn for five days, and then were subjected to a test in a thirty percent relative-humidity atmosphere with the following results:

| State of Garment | Maximum Measured Charges | |
|---|---|---|
| | Garment C | Garment D |
| As worn | 1000–3000 volts | 0–150 volts |
| Seat area | 3000 volts | 1500 volts |
| After wearing | 2500–5000 volts | 50–150 volts |
| Seat area after wearing | greater than 5000 volts | 5000 volts |

A microscopic examination of conductive threads in the seat area of garment D showed that the weight of the wearer had forced the monofilaments 14 to displace enough of the small filaments 12 of the conductive threads to cause appreciable portions of those monofilaments to penetrate the "envelopes" defined by those small filaments. The resulting reductions in the exposed areas of those monofilaments reduced the ability of the seat area of garment D to collect and dissipate charges of static electricity. The charges on the portions of garment D which were close to, but which were not parts of, the seat area of that garment did not exceed 150 volts, because the monofilaments of the conductive threads in those portions did not appreciably penetrate the "envelopes" of those conductive threads. As a result, except where heavy forces were applied to the fabric of garment D, that fabric was able to limit charges thereon to considerably less than six hundred volts.

The dry cleanings were carried out as follows:

| | |
|---|---|
| Machine: | Permac |
| Load: | 200 lbs, dry, synthetic |
| Solvent: | Perchloroethylene, stabilized |
| Basic cycle: | a. Degrease, 150° F. and water injection<br>b. Rinse, 150° F. and detergent injection<br>c. Flush, cool down<br>d. Finish |

The discharge from the degreasing cycle was filtered, distilled and re-used, the discharge from the rinse cycle was filtered and then directed to a holding tank, and the solvent in the holding tank was used for the degreasing cycle. The detergent included a fabric softener/anti stat made by Fabritec International of Cincinnati, Ohio and marketed as Emerbrite No. 7525 of Emery Industries.

The launderings were carried out as follows:

| | |
|---|---|
| Machine: | Landau, 1200 lbs capacity with 4 split pockets |
| Load: | 900 lbs dry, synthetic |
| Basic cycle: | a. Flush: 3 minutes at 135° F., 2 minutes at 160° F.<br>b. Break: add 20 lbs orthosilicate, agitate for 12 minutes at 160° F. (McKesson-Robbins, Triton 48 oz)<br>c. Flush: 2 minutes at 160° F.<br>d. Suds: add 4 lbs orthosilicate, agitate for 7 minutes at 160° F.<br>e. Flush: 2 minutes at 160° F.; 2 minutes at 150° F.<br>f. Bleach: add 6 gal, 1% Na hypochlorite, agitate for 7 minutes at 145° F.<br>g. Flush and cool down: 2 minutes at 150° F., 2 minutes at 140° F., add antichlor and thiosulfite and agitate at 120° F. for 5 minutes |

-continued

| |
|---|
| h. Finishing: tumble dry for 10 minutes at 160° F., cool down for 5 minutes |

Where a set of garments A and B was treated with a softener-antistatic chemical, Wallerstein AS-20 was added to flush and cool down cycle at ½ oz/100 lbs.

An additional set of garments A and B was given a fifty-first laundering so the tests could be made as those garments were removed from the dryer. The relative humidity in the laundry was fifty percent; and, as garment A was removed from the dryer, charges from 400–800 were measured. Also, 1100 volts were measured at one spot on that garment. One minute thereafter, the range of charges had dropped to 100–200 volts and the spot voltage had dropped to 400 volts. Immediately after garment B was removed from the dryer, the charges thereon ranged from 0–150 volts. One minute thereafter, the range of charges had dropped to 0–50 volts.

Other garments A and B were tested to determine the static decay times in seconds after fifty dry cleanings:

| Nature and State of Garment | Static Decay Time in Seconds |
|---|---|
| Garment A removed from package | 3.9 seconds |
| Garment B removed from package | less than one-tenth of a second |
| Garment A washed fifty-one times | 7.3 seconds |
| Garment B washed fifty-one times | 0.22 seconds |
| Garment A dry-cleaned fifty times | acted as insulator |
| Garment B dry-cleaned fifty times | 2.8 seconds |

The 2.8 seconds reading, which was obtained on the garment B that had been dry cleaned fifty times, is due to a degradation of the monofilment 14 by the solvents which were used in the dry cleaning operations. Specifically, microscopic examinations of the monofilaments of various conductive threads in the woven fabric in garment B, after that garment had been given fifty dry cleanings, showed discontinuities in the conductive surfaces which are constituted by the carbon particles of those monofilaments. No such degradation was noted even after the fifty-first laundering; and hence the fabrics which are made from the conductive thread of the present invention are effective for longer periods of time when they are laundered rather than dry cleaned.

The ability of garments, which are made from fabrics that utilize the conductive thread of the present invention, to pass the NFPA 56A test enables those garments to be used in places where static electric charges can damage sensitive microcircuits, sensitive integrated circuits and other sensitive semi-conductors. Further, because the conductive thread of the present invention can be incorporated into woven fabrics which provide "cover" that resists the passage of hair and flaked-off particles of skin, that conductive thread can be used in woven fabrics which are made into garments for "clean room". Where the conductive thread of the present invention is incorporated into herringbone twill or basket woven fabrics for "clean room" garments, each of those fabrics should have a total combined surface area (TCSA) in excess of forty thousand microns per square inch.

The TCSA, in microns per square inch, of a woven fabric is determined by the formula $Dw+Df=TCSA$; where Dw is the number of ends per inch multiplied by the average diameter of those ends in microns, and where Df is the number of picks per inch multiplied by the average diameter of those picks in microns. Where a woven fabric for a "clean room" garment has a herringbone, a twill or a basket weave, Dw should be at least 21,980 microns and Df should be at least 18,840 microns so the TCSA would be at least 40,820 microns per square inch. The maximum TCSA, which could be provided for a fabric that used a herringbone, twill or basket weave and that was used in making garments for "clean rooms", is limited only by the maximum number of ends and picks that can be woven commercially.

Where a woven fabric for a "clean room" garment has a plain weave, Dw should be at least 20,724 microns and Df should be at least 15,700 microns so the TCSA would be at least 36,424 microns per square inch. The maximum TCSA, which could be provided for a fabric that used a plain weave and that was used in making garments for "clean rooms", is limited only by the maximum number of ends and picks that can be woven commercially.

Where a garment is made from woven fabric in which the conductive thread of the present invention is incorporated, the various sections of that garment must be able to interchange any charges of static electricity thereon. The present invention makes certain that such charges can be interchanged by providing double needle, two fold seams between contiguous sections of the garment; and one such seam is shown in FIG. 3. One section of the garment is denoted by the numeral 20, it has a J-shaped fold 22 adjacent one edge thereof, and it has an electrically-conductive grid whic is constituted by conductive warp threads 24 and conductive fill threads 26. Another section of the garment is denoted by the numeral 28, it has a J-shaped fold 30 adjacent one edge thereof, and it has an electrically-conductive grid which is constituted by conductive warp threads 32 and conductive fill threads 34. The free edge of the section 20 is disposed within, and is concealed by, the J-shaped fold 30 of the section 28, and the free edge of the section 28 is disposed within, and is concealed by, the J-shaped fold 22 of the section 20. As a result, the resulting two fold seam totally encloses the free edges of the sections 20 and 28. Two rows of stitching 36 and 38 are indicated by dashed lines; and the row of stitching 36 will pass through the un-bent portion of the section 28, through the reversely-folded portion of the section 28, and through the un-bent portion of the section 20. The row of stitching 38 will pass through the un-bent portion of the section 28, through the reversely-folded portion of the section 20, and through the un-bent portion of the section 20. As a result, both of the needles, and the thread therein, will pass through only three, rather than four, layers of woven fabric in the seam.

It will be noted that the conductive warp threads 24 in the section 20 will engage at least one conductive fill thread 34 in the reversely-folded portion of the section 28, and also will engage at least two conductive fill threads 34 in the un-bent portion of that section. Similarly, it will be noted that the conductive warp threads 32 of the section 28 will engage at least one conductive fill thread 26 in the reversely-folded portion of the section 20, and also will engage at least two of the conductive fill threads 26 in the un-bent portion of the section 20. The resulting engagements between those conductive warp and conductive fill threads will make certain that any charges of static electricity which are collected by the conductive warp threads 24 of section 20 will be transferred to the conductive warp threads 32 of section 28 and vice versa. In this way, garments that are made from woven fabrics which incorporate the conductive threads of the present invention can provide full assurance that—except in the seat and in other areas of heavy use—the average values of charges of static electricity will be less than six hundred volts.

The non-textured, continuous filaments 12, which are used in making the conductive threads of the present invention, are important in limiting the stretching of those conductive threads, in providing strength for those conductive threads, in resisting the penetration of the inner surfaces of the monofilaments 14 into the "envelopes" defined by the filaments 12 of those conductive threads, and in limiting the porosity and linting of woven fabrics in which the conductive threads are incorporated. Where the filaments 12 are made from polyester, they make the resulting woven fabrics wear-resistant, soil-resistant, strong, and resistant to shrinkage. However, if desired, the filaments 12 could be made from polypropylene, nylon, or equivalent polymers.

The monofilament 14 preferably is made from nylon, and carbon particles are the preferred conductive particles that are embedded in the surface of that monofilament. However, if desired, metallic particles, rather than carbon particles, could be embedded in the surface of the nylon monofilament 14. If it ever became commercially practical to form polyester monofilaments with conductive particles embedded in the surfaces thereof, those monofilaments could be used in place of the impregnated nylon monofilaments 14. Similarly, if it ever became commercially practical to form polypropylene monofilaments with conductive particles embedded in the surfaces thereof, those monofilaments could be substituted for the impregnated nylon monofilaments.

Although the preferred embodiment of conductive thread provided by the present invention utilizes a non-textured, continuous 21 denier nylon 6 monofilament which has fine carbon particles embedded in the surface thereof, and also utilizes two non-textured, continuous, 70 denier polyester yarns—each of which has thirty-six filaments, other conductive threads could be used. The following list of usable conductive threads is representative and is not exhaustive; but it should be noted that in each of those conductive threads the percent of weight of the monofilament to the total weight is at least nine and one-half percent:

| Denier of Monofilament 14 | Denier of yarn or yarns used in "envelope" | Percent of weight of monofilament to weight of conductive thread |
|---|---|---|
| 15 | 2 40 yarns | 15.7 |
| 15 | 2 50 yarns | 13.0 |
| 15 | 2 70 yarns | 9.6 |
| 15 | 1 80 yarn | 15.7 |
| 15 | 1 135 yarn | 10.0 |
| 15 | 1 140 yarn | 9.6 |
| 21 | 2 40 yarns | 21.0 |
| 21 | 2 90 yarns | 10.4 |
| 21 | 2 95 yarns | 9.9 |
| 21 | 1 80 yarn | 21.0 |
| 21 | 1 170 yarn | 10.9 |
| 21 | 1 190 yarn | 9.9 |
| 20 | 2 40 yarns | 20.0 |
| 20 | 2 90 yarns | 10.0 |
| 20 | 2 95 yarns | 9.5 |
| 20 | 1 80 yarn | 20.0 |

-continued

| Denier of Monofilament 14 | Denier of yarn or yarns used in "envelope" | Percent of weight of monofilament to weight of conductive thread |
|---|---|---|
| 20 | 1 180 yarn | 10.0 |
| 20 | 1 190 yarn | 9.5 |
| 30 | 2 40 yarns | 27.2 |
| 30 | 2 100 yarns | 13.0 |
| 30 | 1 80 yarn | 27.2 |
| 30 | 1 200 yarn | 13.0 |
| 40 | 2 40 yarns | 33.3 |
| 40 | 2 100 yarns | 16.6 |
| 40 | 1 80 yarn | 33.3 |
| 40 | 1 200 yarn | 16.6 |

Where a woven fabric has a herringbone weave with eighty-two ends and sixty-eight picks in the finished state, where that fabric has a non-textured, continuous 21 denier nylon 6 carbon-impregnated monofilament 14 in each conductive thread thereof, where that fabric has two non-textured, continuous 70 denier polyester yarns—each of which has thirty-six filaments therein—in each conductive thread thereof, and where each monofilament is formed as an open-type helix with from four to four and one-half turns per inch, each of those monofilaments is successively (a) visible in its full width, (b) visible in less than its full width as it passes around one side of the "envelope" of its conductive thread, (c) is not visible because it is rearward of that "envelope", and (d) is not visible because it is overlain by a transversely-directed thread of the woven fabric. However, in each lineal inch of each monofilament 14 of a conductive warp thread, from four tenths to fifty-two hundredths of an inch will be visible. In each lineal inch of each monofilament 14 of a conductive fill thread, from thirty-three hundredths to forty-two hundredths of an inch will be visible. The average percent of the visible length of the monofilament 14 of a conductive warp thread is about forty-three percent; and the average percent of the visible length of the monofilament 14 of a conductive fill thread is about thirty-six hundredths of an inch.

The relatively-high resistance and the relatively-small diameter of each monofilament 14 amply protects the wearer of any garment, which is made from a woven fabric incorporating the conductive thread of the present invention, from any electrocution hazard. Yet, by causing that monofilament to have the configuration of an open-type helix that has the major portion of the surface thereof exposed, by spacing the conductive threads of a woven fabric apart a distance no greater than one-half of an inch, by providing sufficient monofilaments 14 to make the percent of weight of those monofilaments to the total weights of the conductive threads at least nine and one-half percent, and by causing an average of at least thirty-six percent of the lengths of those monofilaments to be visible at one surface of that woven fabric, the present invention enables all areas of a garment—which are made from such a woven fabric and which are not subject to heavy wear—to provide a charge decay of ninety percent from an applied voltage of five thousand volts within one-half of a second and also to limit the charges of static electricity thereon to less than six hundred volts. Further, by using a multitude of fine, non-textured, continuous polyester filaments in the "envelopes" of the conductive threads of such a woven fabric, the present invention enables that fabric to be flexible and soft, to have a desirable "feel" and "hand", and to provide a "cover" which will resist the passage of hair and particles of skin through that fabric.

The grid-like arrangement of the conductive threads 24 and 26 in the section 20 of FIG. 3, and the grid-like arrangement of the conductive threads 32 and 34 of the section 28 in that view are very desirable, because they facilitate the discharging of static electric charges—even if portions of the carbon-impregnated surfaces of the monofilaments 14 of the conductive threads become degraded by repeated dry cleanings. Also, those grid-like arrangements are very desirable in making certain that a number of electrical contacts will automatically be established between the conductive threads of contiguous sections of a garment when those sections are sewn together by a double J-shaped seam. However, if a garment were to be laundered and not dry cleaned, and if the seams between adjacent sections of that garment were to be made with sufficient lapping and with sufficient angular displacement between the conductive threads of those sections to make certain that a number of electrical contacts were established between the conductive warp threads of those sections, that garment could be made from a fabric wherein no conductive fill threads were used.

As shown by FIG. 3, each conductive warp thread will usually be spaced from each other conductive warp thread. Also, each conductive fill thread can be spaced from each other conductive fill thread. However, where a fabric is woven in a box loom, the conductive fill threads of that fabric can be formed as spaced pairs of side-by-side conductive threads.

In the drawing and accompanying description, the conductive thread includes only one conductive monofilament 14. However, if desired, the conductive thread of the present invention could be made to include two or more conductive monofilaments. One such conductive thread could include two fifteen denier non-textured, continuous, conductive monofilaments and two fifty denier non-textured, continuous, multi-filament yarns. Other such conductive threads could be used with different combinations of non-textured, continuous, conductive monofilaments and non-textured, continuous non-conductive multi-filament plies. The use of a single, relatively-large, conductive monofilament 14 in each conductive thread is preferred, because such a monofilament is stronger than two conductive monofilaments of half the diameter. Also, it is easier to make a single, relatively-large, conductive monofilament than it would be to make two conductive monofilaments of half the diameter.

Whereas the drawing and accompanying description have shown and described a preferred embodiment of the present invention, it should be apparent to those skilled in the art that various changes may be made in the form of the invention without affecting the scope thereof.

What I claim is:

1. A woven fabric which substantially prevents the passage therethrough of hair and flaked-off particles of skin and which is readily laundered and which exhibits a charge decay of ninety percent from an applied voltage of five thousand volts within one-half of a second and which limits the average electrostatic charge that can be measured on said fabric to less than one hundred volts, even after many launderings, and hence is usable in making garments for "clean rooms" wherein static-sensitive devices are handled, and which comprises a first plurality of threads and a second plurality of threads, the threads of said first plurality of threads being essentially parallel to each other and extending in one direction, the threads of said second plurality of threads extending transversely of said one direction, one of said plurality of threads having the major portion thereof constituted by threads that are electrically resistive and having the minor portions thereof constituted by threads that are electrically conductive, each of said electrically-resistive threads of said one plurality of threads comprising a multiplicity of non-textured, continuous, non-conductive filaments, each of said electrically-conductive threads of said one plurality of threads being a plural-ply thread, at least one ply of each of said electrically-conductive threads of said one plurality of threads being non-textured and continuous and having a denier of at least fifteen (15) and having conductive material at the surface thereof to render said one ply especially adapted to conduct static electricity, at least one other ply of each of said electrically-conductive threads of said one plurality of threads including non-textured, continuous non-conductive filaments to help make said electrically-conductive threads resistant to breaking, whereby said electrically-conductive threads can be woven into said fabric on commercial looms on a commercial scale and can remain substantially intact despite fifty commercial launderings, said conductive material at said surface of said one ply of each of said electrically-conductive threads of said one plurality of threads providing an essentially-continuous and essentially-uninterrupted electrically-conductive path through the entire length thereof, said one ply of each of said electrically-conductive threads of said one plurality of threads being an identifiable ply of a diameter larger than each of said non-conductive filaments and that has the configuration of an open-type helix and that has a very substantial portion of the surface thereof exposed at the surface of said electrically-conductive thread, whereby the conductive surface of said one ply of each of said electrically-conductive threads of said one plurality of threads constitutes an exposed and visible part of the surface of said electrically-conductive thread, and whereby said conductive surfaces of said one ply coact to help provide said charge decay of ninety percent from an applied voltage of five thousand volts within one-half of a second and also to help limit the average electrostatic charge that can be measured on said fabric to less than one hundred volts.

2. A woven fabric which substantially prevents the passage therethrough of hair and flaked-off particles of skin and which is readily laundered and which exhibits a charge decay of ninety percent from an applied voltage of five thousand volts within one-half of a second, even after many launderings, and hence is usable in making garments for "clean rooms" wherein static-sensitive devices are handled, and which comprises a first plurality of threads and a second plurality of threads, the threads of said first plurality of threads being essentially parallel to each other and extending in one direction, the threads of said second plurality of threads extending transversely of said one direction, said fabric having a total combined surface area greater than thirty-six thousand microns per square inch, one of said plurality of threads having the major portion thereof constituted by threads that are electrically resistive and having the minor portion thereof constituted by threads that are electrically-conductive, each of said electrically-resistive threads of said one plurality of threads comprising a multiplicity of non-textured, continuous, non-conductive filaments, each of said electrically-conductive threads of said one plurality of threads being a plural-ply thread, at least one ply of each of said electrically-conductive threads of said one plurality of threads being non-textured and continuous and having a denier of at least fifteen (15) and having conductive material at the surface thereof to render said one ply especially adapted to conduct static electricity, at least one other ply of each of said electrically-conductive threads of said one plurality of threads including non-textured, continuous non-conductive filaments to help make said electrically-conductive threads resistant to breaking, whereby said electrically-conductive threads can be woven into said fabric on commercial looms on a commercial scale and can remain substantially intact despite fifty commercial launderings, said conductive material at said surface of said one ply of each of said electrically-conductive threads of said one plurality of threads providing an essentially-continuous and essentially-uninterrupted electrically-conductive path through the entire length thereof, said one ply having a diameter larger than each of said non-conductive filaments of said other ply, said one ply and at least said one other ply of each of said electrically-conductive threads of said one plurality of threads being formed as separate plies and then twisted together to give said one ply of each of said electrically-conductive threads of said one plurality of threads the configuration of an open-type helix which has a very substantial portion thereof exposed at the surface of said electrically-conductive thread, whereby the conductive surface of said one ply of each of said electrically-conductive threads of said one plurality of threads constitutes an exposed and visible part of the surface of said electrically-conductive thread, and wherein said conductive surfaces of said one ply of each of said electrically-conductive threads of said one plurality of threads coact to help provide said charge decay of ninety percent from an applied voltage of five thousand volts within one-half of a second.

3. A woven fabric as claimed in claim 2 wherein the major portion of said one ply of each of said electrically-conductive threads of said one plurality of threads is spaced from the axis of said conductive thread a distance greater than the radius of said one other ply of said conductive thread.

4. A woven fabric which substantially prevents the passage therethrough of hair and flaked-off particles of skin and which is readily laundered and which exhibits a charge decay of ninety percent from an applied voltage of five thousand volts within one-half of a second, and which limits the average electrostatic charge that can be measured on said fabric to less than one hundred volts, even after many launderings, and hence is usable in making garments for "clean rooms" wherein static-sensitive devices are handled, and which comprises a first plurality of threads and a second plurality of threads, the threads of said first plurality of threads being essentially parallel to each other and extending in one direction, the threads of said second plurality of threads extending transversely of said one direction, said fabric having a total combined surface area greater than thirty-six thousand microns per square inch, one of said plurality of threads having the major portion thereof constituted by threads that are electrically-resistive and having the minor portion thereof constituted by threads that are electrically-conductive, each of said electrically-resistive threads of said one plurality of threads comprising a multiplicity of non-textured, continuous, non-conductive filaments, each of said electrically-conductive threads of said one plurality of threads being a plural-ply thread, at least one ply of each of said electrically-conductive threads of said one plurality of threads being non-textured and continuous and having a denier of at least fifteen (15) and a diameter greater than each of said non-conductive filaments and having conductive material at the surface thereof to render said one ply especially adapted to conduct static electricity, at least one other ply of each of said electrically-conductive threads of said one plurality of threads including non-textured, continuous non-conductive filaments to help make said electrically-conductive threads resistant to breaking, whereby said electrically-conductive threads can be woven into said fabric on commercial looms on a commercial scale and can remain substantially intact despite fifty commercial launderings, said conductive material at said surface of said one ply of each of said electrically-conductive threads of said one plurality of threads providing an essentially-continuous and essentially-uninterrupted electrically-conductive path through the entire length thereof, each of said plies of each of said electrically-conductive threads of said one plurality of threads being formed as a separate ply whereby each of said electrically-conductive threads of said one plurality of threads has a plurality of separately-formed plies that are ply-twisted together, said one ply of each of said electrically-conductive threads of said one plurality of threads having the configuration of an open-type helix that is twisted around, and is largely external of, the rest of said electrically-conductive thread so said one ply has a very substantial portion of the area thereof exposed at the surface of said electrically-conductive thread, whereby the conductive surface of said one ply of each of said electrically-conductive threads of said one plurality of threads constitutes an exposed and visible part of the surface of said electrically-conductive thread, and whereby said conductive surfaces of said one ply of each of said electrically-conductive threads of said one plurality of threads coact to help provide said charge decay of ninety percent from an applied voltage of five thousand volts within one-half of a second and also to help limit the average electrostatic charge that can be measured on said fabric to less than one hundred volts.

* * * * *